US008076637B2

(12) United States Patent
Pringle et al.

(10) Patent No.: US 8,076,637 B2
(45) Date of Patent: Dec. 13, 2011

(54) MASS SPECTROMETER

(75) Inventors: Steven Derek Pringle, Darwen (GB); Jason Lee Wildgoose, Stockport (GB)

(73) Assignee: Micromass UK Limited, Manchester (GB)

( * ) Notice: Subject to any disclaimer, the term of this patent is extended or adjusted under 35 U.S.C. 154(b) by 111 days.

(21) Appl. No.: 12/524,378

(22) PCT Filed: Jan. 25, 2008

(86) PCT No.: PCT/GB2008/000275
§ 371 (c)(1),
(2), (4) Date: Nov. 13, 2009

(87) PCT Pub. No.: WO2008/090365
PCT Pub. Date: Jul. 31, 2008

(65) Prior Publication Data

US 2010/0084547 A1 Apr. 8, 2010

Related U.S. Application Data

(60) Provisional application No. 60/890,714, filed on Feb. 20, 2007.

(30) Foreign Application Priority Data

Jan. 25, 2007 (GB) ..... 0701476.4

(51) Int. Cl.
*H01J 49/42* (2006.01)
*H01J 49/00* (2006.01)

(52) U.S. Cl. ..... 250/282; 250/281; 250/288; 250/290; 250/291; 250/292

(58) Field of Classification Search ..... 250/281, 250/282, 288, 290, 291, 292
See application file for complete search history.

(56) References Cited

U.S. PATENT DOCUMENTS

| | | | | |
|---|---|---|---|---|
| 5,324,939 | A | 6/1994 | Louris et al. | |
| 5,436,445 | A * | 7/1995 | Kelley et al. | 250/282 |
| 5,438,195 | A | 8/1995 | Franzen et al. | |
| 5,449,905 | A * | 9/1995 | Hoekman et al. | 250/282 |
| 5,561,291 | A * | 10/1996 | Kelley et al. | 250/282 |
| 5,598,001 | A | 1/1997 | Flory et al. | |

(Continued)

FOREIGN PATENT DOCUMENTS

GB 2421842 7/2006

(Continued)

OTHER PUBLICATIONS

Harkewicz et al, ESI-FTICR Mass Spectrometry Employing Data-Dependent External Ion Selection and Accumulation, 2002, Journal of the American Society for Mass Spectrometry, pp. 144-154, vol. 13, Elsevier Science Inc.

(Continued)

*Primary Examiner* — David A Vanore
(74) *Attorney, Agent, or Firm* — Diederiks & Whitelaw PLC

(57) ABSTRACT

A mass spectrometer is disclosed comprising a quadrupole rod set ion guide or mass filter device. Broadband frequency-signals (13, 14, 15) having a plurality of frequency notches (16*a*; 16*b*; 16*c*) are applied sequentially to the rods of the quadrupole rod set. The notched broadband frequency signals (16*a*, 16*b*, 16*c*) cause undesired ions to be resonantly or parametrically ejected from the ion guide. The resulting ion signals are deconvoluted to provide a mass spectrum.

15 Claims, 7 Drawing Sheets

U.S. PATENT DOCUMENTS

| | | | | |
|---|---|---|---|---|
| 5,679,951 | A * | 10/1997 | Kelley et al. | 250/282 |
| 5,864,136 | A * | 1/1999 | Kelley et al. | 250/282 |
| 6,861,644 | B2 * | 3/2005 | Miseki | 250/282 |
| 6,992,283 | B2 * | 1/2006 | Bateman et al. | 250/287 |
| 7,034,292 | B1 | 4/2006 | Whitehouse et al. | |
| 7,060,972 | B2 * | 6/2006 | Hager | 250/282 |
| 7,378,648 | B2 * | 5/2008 | Wang et al. | 250/282 |
| 7,586,088 | B2 * | 9/2009 | Bateman et al. | 250/281 |
| 7,755,034 | B2 * | 7/2010 | Ding | 250/283 |
| 7,829,841 | B2 * | 11/2010 | Bateman et al. | 250/281 |
| 7,858,926 | B1 * | 12/2010 | Whitehouse et al. | 250/281 |
| 7,910,877 | B2 * | 3/2011 | Horn et al. | 250/282 |
| 2007/0023635 | A1 * | 2/2007 | Bateman et al. | 250/282 |
| 2007/0084994 | A1 * | 4/2007 | Wang et al. | 250/282 |
| 2007/0278397 | A1 * | 12/2007 | Bateman et al. | 250/286 |
| 2009/0121126 | A1 * | 5/2009 | Collings et al. | 250/282 |
| 2009/0261247 | A1 * | 10/2009 | Cooks et al. | 250/292 |
| 2011/0042565 | A1 * | 2/2011 | Bateman et al. | 250/287 |

FOREIGN PATENT DOCUMENTS

| | | |
|---|---|---|
| JP | 06-505826 | 6/1994 |
| JP | 09-213265 | 8/1997 |
| JP | 2005-045372 | 2/2003 |
| JP | 2005-181236 | 7/2005 |
| JP | 2008-521189 | 6/2008 |
| WO | 9309562 | 5/1993 |

OTHER PUBLICATIONS

Japanese Notification of Reason for Rejection, Application No. 2009-546814, dispatched date: Mar. 29, 2011.

* cited by examiner

MASS SPECTROMETER

CROSS REFERENCE TO RELATED APPLICATIONS

This application is the National Stage of International Application No. PCT/GB2008/000275, filed Jan. 25, 2008, which claims priority to and benefit of United Kingdom Patent Application No. 0701476.4, filed Jan. 25, 2007 and U.S. Provisional Patent Application Ser. No. 60/890,714, filed Feb. 20, 2007. The entire contents of these applications are incorporated herein by reference.

The present invention relates to an ion guide or mass filter device, a method of guiding or mass filtering ions, a mass spectrometer and a method of mass spectrometry.

RF quadrupole rod sets are known comprising four parallel rods. An RF voltage is applied between adjacent rods and the RF quadrupole rod set is commonly used as an ion guide, a mass filter or mass analyzer. It is also known to use a quadrupole rod set to form part of a linear ion trap wherein additional axial trapping potentials are applied in order to confine ions axially within the quadrupole rod set.

A quadrupole rod set comprising four parallel rods may be used as an ion guide to transmit ions without substantially mass filtering the ions by applying a two-phase RF signal or voltage to the rods. Adjacent rods are arranged to have opposite phases of the RF signal or voltage applied to them. The application of an RF signal or voltage to the rods generates a radial pseudo-potential valley which acts to confine ions radially within the quadrupole rod set. The four rods are maintained at the same DC potential or voltage. The quadrupole rod set ion guide may, in practice, exhibit an inherent low mass to charge ratio cut-off and the transmission efficiency of the ion guide may gradually reduce at relatively high mass to charge ratios. Nonetheless, the known quadrupole rod set ion guide may be considered as being capable of transmitting effectively ions having a wide range of mass to charge ratios in a substantially simultaneous manner.

A quadrupole rod set may also be operated as a mass filter or mass analyzer. According to this arrangement an RF signal or voltage is applied to the rods in a similar manner as when the quadrupole rod set is operated in an ion guide only mode of operation i.e. adjacent rods are supplied with opposite phases of a two-phase RF signal or voltage. However, instead of maintaining all the rods at the same DC voltage or potential, a DC component of voltage is applied or maintained between adjacent rods. By applying an RF voltage to the rods and by also maintaining a DC potential difference between adjacent rods the quadrupole rod set can be arranged to act as a mass filter wherein only ions having mass to charge ratios falling within well defined upper and lower mass to charge ratios are transmitted onwardly by the quadrupole rod set mass filter.

The mass to charge ratio transmission window of the mass filter can be narrowed to a point such that substantially only a single species of ion having a specific mass to charge ratio will be transmitted onwardly by the quadrupole rod set mass filter. Mass spectra can be obtained by scanning the RF and DC signals as a function of time so as to transmit ions having different mass to charge ratios selectively and sequentially.

A quadrupole rod set may also form part of a linear quadrupole ion trap. According to this arrangement an RF signal or voltage is applied to the rods in order to confine ions radially in a similar manner to a quadrupole rod set operated, in an ion guide only mode as described above. The rods are all maintained at the same DC potential or voltage. In addition, axial potential barriers are maintained at the entrance and exit of the quadrupole rod set in order to prevent ions, once injected into the rod set, from exiting the rod set in an axial direction. Ions are therefore effectively trapped within the quadrupole rod set. Once ions have been trapped within the ion trap, supplemental AC waveforms may be applied to the electrodes forming the ion trap in order to mass selectively eject certain ions either axially or radially from the ion trap. The frequency of the supplemental AC waveform applied to the electrodes can be scanned so as to eject ions mass selectively in sequence from the ion trap thereby enabling a mass spectrum to be produced. The resonance or first harmonic frequency $\omega_r$ for ion excitation in a confining RF field is given by:

$$\omega_r = \frac{\beta\Omega}{2} \tag{1}$$

wherein $\Omega$ is the angular frequency of the main confining RF voltage and $\beta$ is a parameter related to the mass to charge ratio of an ion through the Matthieu stability parameters a and q.

A conventional quadrupole rod set mass filter will now be considered in more detail. Operating the mass filter in a mass resolving mode will provide better specificity than operating the mass filter in an ion guide only or non-resolving mode. However, when the mass filter is scanned to generate a mass spectrum only one species of ions will be transmitted at a time whilst the rest of the ions will be discarded. The efficiency or duty cycle DC of the quadrupole rod set mass filter in the scanning mode is given approximately by the following expression:

$$DC=W/(M_h-M_1) \tag{2}$$

wherein W is the peak width at half height, $M_h$ is the highest mass to charge ratio in the scan and $M_1$ is the lowest mass to charge ratio in the scan.

For example, if the highest mass to charge ratio is 900, the lowest mass to charge ratio is 100 and the peak width at half height is 0.5 mass units then the duty cycle DC is 1 in 1600 or 0.0625%.

It can be seen that the duty cycle for a quadrupole rod set mass filter operating in a scanning mode is very low.

In contrast, when monitoring a single mass, the efficiency or duty cycle of a quadrupole rod set mass filter is very high, usually 100%. However, if the quadrupole rod set mass filter is required to monitor a number N of masses of interest by switching in sequence from one mass of interest to the next then the duty cycle typically reduces to 1/N.

It is desired to provide an improved mass filter device.

According to an aspect of the present invention there is provided a method of guiding or mass filtering ions comprising:

providing an ion guide or mass filter device comprising a plurality of electrodes or rods;

applying an AC or RF voltage to the plurality of electrodes or rods;

supplying a plurality of signals to the plurality of electrodes or rods, wherein the step of supplying the plurality of signals comprises at least the steps of:

(i) supplying a first signal to the plurality of electrodes or rods in order to resonantly or parametrically excite undesired ions within or from the ion guide or mass filter device, the first signal also comprising a plurality of frequency notches, and obtaining a first set of data; and then (ii) supplying a second different signal to the plurality of electrodes or rods in order to resonantly or parametrically excite undesired ions within or from the ion guide or mass filter device, the second signal comprising a plurality of frequency notches, and obtaining a second set of data; and deconvoluting, decoding or demodulating the first set of data and/or the second set of data to determine the intensity of ions having a plurality of different mass to charge ratios.

According to the preferred embodiment the step of supplying a plurality of signals further comprises supplying n additional signals to the plurality of electrodes or rods in sequence in order to resonantly or parametrically excite undesired ions within or from the ion guide or mass filter device and obtaining n additional sets of data, wherein the n additional signals each comprise a plurality of frequency notches; and wherein the step of deconvoluting, decoding or demodulating further comprises deconvoluting, decoding or demodulating the additional sets of data to determine the intensity of ions having a plurality of different masses or mass to charge ratios;

wherein n is selected from the group consisting of: (i) 1; (ii) 2; (iii) 3; (iv) 4; (v) 5; (vi) 6; (vii) 7; (viii) 8; (ix) 9; (x) 10; (xi) 11; (xii) 12; (xiii) 13; (xiv) 14; (xv) 15; (xvi) 16; (xvii) 17; (xviii) 18; (xix) 19; (xx) 20; (xxi) 20-25; (xxii) 25-30; (xxiii) 30-35; (xxiv) 35-40; (xxv) 40-45; (xxvi) 45-50; (xxvii) 50-55; (xxviii) 55-60; (xxix) 60-65; (xxx) 65-70; (xxxi) 70-75; (xxxii) 75-80; (xxxiii) 80-85; (xxxiv) 85-90; (xxxv) 90-95; (xxxvi) 95-100; and (xxxvii) >100.

The first set of data and/or the second set of data and/or the additional sets of data preferably comprise time of flight or mass spectral data. However, if specific ions are being monitored and hence the mass to charge ratio is already known, then the sets of data may comprise just intensity value(s).

The step of applying an AC or RF voltage preferably further comprises:

(a) applying a two phase voltage to the plurality of electrodes or rods wherein opposite phases of the AC or RF voltage are applied to adjacent electrodes or rods in order to confine ions radially within the ion guide or mass filter device; and/or (b) applying an AC or RF voltage having an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-1000 V peak to peak; (xii) 1-2 kV peak to peak; (xiii) 2-3 kV peak to peak; (xiv) 3-4 kV peak to peak; (xv) 4-5 kV peak to peak; (xvi) 5-6 kV peak to peak; (xvii) 6-7 kV peak to peak; (xviii) 7-8 kV peak to peak; (xix) 8-9 kV peak to peak; (xx) 9-10 kV peak to peak; and (xxi) >10 kV peak to peak; and/or (c) applying an AC or RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The step of supplying the first signal and/or the second signal and/or the additional signals preferably results in at least some undesired ions being ejected radially from the ion guide or mass filter device or otherwise being substantially attenuated.

At least some ions are preferably onwardly transmitted without being substantially confined or trapped axially within the ion guide or mass filter device. This is in contrast to an ion trap arrangement wherein ions are confined axially within the ion trap.

The step of providing an ion guide or mass filter device preferably comprises providing a quadrupole rod set ion guide or mass filter device.

The preferred embodiment preferably further comprises maintaining a radial quadratic potential distribution or a radial linear electric field within the ion guide or mass filter device.

The step of supplying the first signal and/or the second signal and/or the additional signals preferably comprises:

(a) supplying a broadband frequency signal to the plurality of electrodes or rods; and/or (b) supplying a broadband frequency signal to the plurality of electrodes or rods wherein the first signal and/or the second signal and/or the additional signals comprise one or more frequency components selected from one of more of the following ranges: (i) <1 kHz; (ii) 1-2 kHz; (iii) 2-3 kHz; (iv) 3-4 kHz; (v) 4-5 kHz; (vi) 5-6 kHz; (vii) 6-7 kHz; (viii) 7-8 kHz; (ix) 8-9 kHz; (x) 9-10 kHz; (xi) 10-11 kHz; (xii) 11-12 kHz; (xiii) 12-13 kHz; (xiv) 13-14 kHz; (xv) 14-15 kHz; (xvi) 15-16 kHz; (xvii) 16-17 kHz; (xviii) 17-18 kHz; (xix) 18-19 kHz; (xx) 19-20 kHz; (xxi) 20-21 kHz; (xxii) 21-22 kHz; (xxiii) 22-23 kHz; (xxiv) 23-24 kHz; (xxv) 24-25 kHz; (xxvi) 25-26 kHz; (xxvii) 26-27 kHz; (xxviii) 27-28 kHz; (xxix) 28-29 kHz; (xxx) 29-30 kHz; and (xxxi) >30 kHz; and/or (c) supplying a signal having a dipolar and/or a quadrupolar waveform; and/or (d) supplying a signal having a plurality of frequency components which correspond with the secular, resonance, first or fundamental harmonic frequency of a plurality of ions received in use by the ion guide or mass filter device.

The first signal and/or the second signal and/or the additional signals preferably comprise at least 2, 3, 4, 5, 6, 7, 8, 9, 10, 11, 12, 13, 14, 15, 16, 17, 18, 19, 20, 20-25, 25-30, 30-35, 35-40, 40-45, 45-50, 50-55, 55-60, 60-65, 65-70, 70-75, 75-80, 80-85, 85-90, 90-95, 95-100 or >100 frequency notches.

The plurality of frequency notches preferably correspond with:

(a) the secular, resonance, first or fundamental harmonic frequencies of ions having a plurality of different mass to charge ratios which are desired to be onwardly transmitted by the ion guide or mass filter device; and/or (b) the secular, resonance or first, fundamental harmonic frequencies of at least 2, 3, 4, 5, 6, 7, 8, 9, 10, 11, 12, 13, 14, 15, 16, 17, 18, 19, 20, 20-25, 25-30, 30-35, 35-40, 40-45, 45-50, 50-55, 55-60, 60-65, 65-70, 70-75, 75-80, 80-85, 85-90, 90-95, 95-100 or >100 different species of analyte ion of interest.

The first signal and/or the second signal and/or the additional signals preferably do not substantially cause at least some analyte ions of interest to be resonantly or parametrically excited and/or radially ejected from the ion guide or mass filter device.

According to the preferred embodiment at frequencies corresponding to the plurality of frequency notches either:

(a) ions within the ion guide or mass filter device are not substantially resonantly or parametrically excited; or (b) ions within the ion guide or mass filter device are resonantly or parametrically excited but are not sufficiently resonantly or parametrically excited such that the ions are caused to be radially ejected from the ion guide or mass filter device.

According to the preferred embodiment the first signal and/or the second signal is preferably arranged and adapted:

(i) to cause ions having mass to, charge ratios of M1 and M3 to be simultaneously onwardly transmitted by the ion guide or mass filter device; and/or (ii) to cause ions having a mass to charge ratio of M2 to be substantially attenuated by or resonantly or parametrically ejected from the ion guide or mass filter device, wherein M1<M2<M3; and/or (iii) to cause ions having mass to charge ratios of M3 and M5 to be simultaneously onwardly transmitted by the ion guide or mass filter device; and/or (iv) to cause ions having a mass to charge ratio of M4 to be substantially attenuated by or resonantly or parametrically ejected from the ion guide or mass filter device, wherein M3<M4<M5.

The first signal and/or the second signal and/or the additional signals preferably cause the ion guide or mass filter device to have a plurality or at least 2, 3, 4, 5, 6, 7, 8, 9, 10, 11, 12, 13, 14, 15, 16, 17, 18, 19, 20, 20-25, 25-30, 30-35, 35-40, 40-45, 45-50, 50-55, 55-60, 60-65, 65-70, 70-75, 75-80, 80-85, 85-90, 90-95, 95-100 or >100 discrete or separate simultaneous mass to charge ratio transmission windows such that:

(a) an ion having amass to charge ratio falling within a mass to charge ratio transmission window will be onwardly transmitted by the ion guide or mass filter device; and/or (b) an ion having a mass to charge ratio falling outside of a mass to charge ratio transmission window will be substantially attenuated by and/or resonantly or parametrically ejected from the ion guide or mass filter device.

The discrete or separate simultaneous mass to charge ratio transmission windows are preferably substantially non-overlapping and/or non-continuous.

According to the preferred embodiment either:

(a) the centre and/or width of one or more of the mass to charge ratio transmission windows remains substantially constant with time or over a time period selected from the group consisting of: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; (xxxi) 30-40 ms; (xxxii) 40-50 ms; (xxxiii) 50-60 ms; (xxxiv) 60-70 ms; (xxxv) 70-80 ms; (xxxvi) 80-90 ms; (xxxvii) 90-100 ms; (xxxviii) 100-200 ms; (xxxix) 200-300 ms; (xl) 300-400 ms; (xli) 400-500 ms; (xlii) 500-600 Ms; (xliii) 600-700 ms; (xliv) 700-800 ms; (xlv) 800-900; (xlvi) 900-1000 ms; and (xlvii) >1 s; or (b) the centre and/or width of one or more of the mass to charge ratio transmission windows substantially varies and/or increases and/or decreases with time or over a time period selected from the group consisting of: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; (xxxi) 30-40 ms; (xxxii) 40-50 ms; (xxxiii) 50-60 ms; (xxxiv) 60-70 ms; (xxxv) 70-80 ms; (xxxvi) 80-90 ms; (xxxvii) 90-100 ms; (xxxviii) 100-200 ms; (xxxix) 200-300 ms; (xl) 300-400 ms; (xli) 400-500 ms; (xlii) 500-600 ms; (xliii) 600-700 ms; (xliv) 700-800 ms; (xlv) 800-900; (xlvi) 900-1000 ms; and (xlvii) >1 s.

According to the preferred embodiment in a mode of operation either:

(a) substantially all of the electrodes or rods are maintained at substantially the same DC potential or voltage; or (b) the ion guide or mass filter device is operated in a substantially non-resolving or ion guiding mode of operation; or (c) adjacent electrodes or rods are maintained at substantially different DC potentials or voltages; or (d) a DC potential or voltage difference is maintained between adjacent electrodes or rods; or (e) opposed electrodes or rods are maintained at substantially the same DC potential or voltage; or (f) the ion guide or mass filter device is operated in a resolving or mass filtering mode of operation; or (g) a combination of DC and/or AC or RF voltages are applied to the plurality of electrodes or rods such that the ion guide or mass filter device is arranged to operate either in a low pass, a band pass or a high pass mass filtering mode of operation.

According to the preferred embodiment in a mode of operation the ion guide or mass filter device has one or more mass to charge ratio transmission windows, wherein one or more of the mass to charge ratio transmission windows has a width of z mass units, wherein z falls within a range selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-15; (xii) 15-20; (xiii) 20-25; (xiv) 25-30; (xv) 30-35; (xvi) 35-40; (xvii) 40-45; (xviii) 45-50; (xix) 50-60; (xx) 60-70; (xxi) 70-80; (xxii) 80-90; (xxiii) 90-100; (xxiv) 100-120; (xxv) 120-140; (xxvi) 140-160; (xxvii) 160-180; (xxviii) 180-200; (xxix) 200-250; (xxx) 250-300; (xxxi) 300-350; (xxxii) 350-400; (xxxiii) 400-450; (xxxiv) 450-500; and (xxxv) >500.

According to the preferred embodiment the ion guide or mass filter device is preferably maintained at a pressure: (i) >100 mbar; (ii) >10 mbar; (iii) >1 mbar; (iv) >0.1 mbar; (v) $>10^{-2}$ mbar; (vi) $>10^{-3}$ mbar; (vii) $>10^{-4}$ mbar; (viii) $>10^{-5}$ mbar; (ix) $>10^{-6}$ mbar; (x) <100 mbar; (xi) <10 mbar; (xii) <1 mbar; (xiii) <0.1 mbar; (xiv) $<10^{-2}$ mbar; (xv) $<10^{-3}$ mbar; (xvi) $<10^{-4}$ mbar; (xvii) $<10^{-5}$ mbar; (xviii) $<10^{-5}$ mbar; (xix) 10-100 mbar; (xx) 1-10 mbar; (xxi) 0.1-1 mbar; (xxii) $10^{-2}$ to $10^{-1}$ mbar; (xxiii) $10^{-3}$ to $10^{-2}$ mbar; (xxiv) $10^{-4}$ to $10^{-3}$ mbar; and (xxv) $10^{-5}$ to $10^{-4}$ mbar.

According to another aspect of the present invention there is provided a method of mass spectrometry comprising a method as described above.

According to another aspect of the present invention there is provided an ion guide or mass filter device comprising:

a plurality of electrodes or rods;

an AC or RF voltage supply for supplying an AC or RF voltage to the plurality of electrodes or rods;

signal means arranged and adapted:

(i) to supply a first signal to the plurality of electrodes or rods in order to resonantly or parametrically excite undesired ions within or from the ion guide or mass filter device, the first signal also comprising a plurality of frequency notches, and wherein a first set of data is obtained; and then (ii) to supply a second different signal to the plurality of electrodes or rods in order to resonantly or parametrically excite undesired ions within or from the ion guide or mass filter device, the second signal also comprising a plurality of frequency notches, and wherein a second set of data is obtained; and a device for deconvoluting, decoding or demodulating the first set of data and/or the second set of data to determine the intensity of ions having a plurality of different mass to charge ratios.

The signal means is preferably arranged and adapted to supply n additional signals to the plurality of electrodes or rods in sequence in order to resonantly or parametrically excite undesired ions within or from the ion guide or mass filter device and wherein n additional sets of data are obtained, wherein the n additional signals each comprise a plurality of frequency notches; and wherein the device for deconvoluting, decoding or demodulating is arranged and adapted to deconvolute, decode or demodulate the additional sets of data to determine the intensity of ions having a plurality of different masses or mass to charge ratios;

wherein n is selected from the group consisting of: (i) 1; (ii) 2; (iii) 3; (iv) 4; (v) 5; (vi) 6; (vii) 7; (viii) 8; (ix) 9; (x) 10; (xi) 11; (xii) 12; (xiii) 13; (xiv) 14; (xv) 15; (xvi) 16; (xvii) 17; (xviii) 18; (xix) 19; (xx) 20; (xxi) 20-25; (xxii) 25-30; (xxiii) 30-35; (xxiv) 35-40; (xxv) 40-45; (xxvi) 45-50; (xxvii) 50-55; (xxviii) 55-60; (xxix) 60-65; (xxx) 65-70; (xxxi) 70-75; (xxxii) 75-80; (xxxiii) 80-85; (xxxiv) 85-90; (xxxv) 90-95; (xxxvi) 95-100; and (xxxvii) >100.

According to another aspect of the present invention there is provided a mass spectrometer comprising an ion guide or mass filter device as described above.

According to the preferred embodiment the mass spectrometer preferably further comprises either:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source; and/or (b) an ion mobility spectrometer or separator and/or a Field Asymmetric Ion Mobility Spectrometer device arranged upstream and/or downstream of the ion guide or mass filter device; and/or (c) an ion trap or ion trapping region arranged upstream and/or downstream of the ion guide or mass filter device; and/or (d) a collision, fragmentation or reaction device arranged upstream and/or downstream of the ion guide or mass filter device, wherein the collision, fragmentation or reaction device is selected from the group consisting of: (i) a Collisional Induced Dissociation ("CID") fragmentation device; (ii) a Surface Induced Dissociation ("SID") fragmentation device; (iii) an Electron Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions; and/or (e) a mass analyzer selected from the group consisting of: (i) a quadrupole mass analyzer; (ii) a 2D or linear quadrupole mass analyzer; (iii) a Paul or 3D quadrupole mass analyzer; (iv) a Penning trap mass analyzer; (v) an ion trap mass analyzer; (vi) a magnetic sector mass analyzer; (vii) Ion Cyclotron Resonance ("ICR") mass analyzer; (viii) a Fourier Transform Ion Cyclotron Resonance ("FTICR") mass analyzer; (ix) an electrostatic or orbitrap mass analyzer; (x) a Fourier Transform electrostatic or orbitrap mass analyzer; (xi) a Fourier Transform mass analyzer; (xii) a Time of Flight mass analyzer; (xiii) an orthogonal acceleration Time of Flight mass analyzer; and (xiv) a linear acceleration Time of Flight mass analyzer.

According to a particularly preferred embodiment an Electrospray or other Atmospheric Pressure ion source is provided in combination with an ion guide or mass filter device according to the preferred embodiment. A collision, fragmentation or reaction device is preferably provided downstream of the preferred ion guide or mass filter to fragment parent ions which emerge from the preferred ion guide or mass filter device. The collision, fragmentation or reaction device preferably comprises a Collision Induced Dissociation fragmentation device. According to a preferred embodiment an orthogonal acceleration Time of Flight mass analyzer may be provided downstream of the collision, fragmentation or reaction device. According to another preferred embodiment a second preferred ion guide or mass filter device may be provided downstream of the collision, fragmentation or reaction device. An ion detector is preferably provided downstream of the second preferred ion guide or mass filter device.

According to another aspect of the present invention there is provided a method of guiding or mass filtering ions comprising:

modulating, varying or synthesising a broadband frequency signal wherein a plurality of signals each having two or more frequency notches are sequentially generated and/or applied to an ion guide or mass filter device;

detecting ions transmitted by the ion guide or mass filter using an ion detector; and demodulating, deconvoluting, decoding or deconstructing a signal output by the ion detector in order to determine the intensity of ions having a plurality of different mass to charge ratios.

The step of demodulating, deconvoluting, decoding or deconstructing preferably comprises using a phase locked amplifier and/or a neural network and/or a decoding routine or algorithm and/or a wavelet based demodulation technique.

According to another aspect of the present invention there is provided an apparatus comprising:

an ion guide or mass filter device;

a device for modulating, varying or synthesising a broadband frequency signal wherein a plurality of signals each having two or more frequency notches are sequentially generated and/or applied to the ion guide or mass filter device;

an ion detector for detecting ions transmitted by the ion guide or mass filter; and a device for demodulating, deconvoluting, decoding or deconstructing a signal output by the ion detector in order to determine the intensity of ions having a plurality of different mass to charge ratios.

The device for demodulating, deconvoluting, decoding or deconstructing preferably comprises a phase locked amplifier and/or a neural network and/or a decoding routine or algorithm and/or a wavelet based demodulator.

According to another aspect of the present invention there is provided apparatus comprising:

a first ion guide or mass filter device;

a collision, fragmentation or reaction device arranged downstream of the first ion guide or mass filter device;

a second ion guide or mass filter device arranged downstream of the collision, fragmentation or reaction device;

wherein the first ion guide or mass filter device comprises:

(a) a first plurality of electrodes or rods;

(b) a first AC or RF voltage supply for supplying a first AC or RF voltage to the first plurality of electrodes or rods; and (c) a signal means arranged and adapted: (i) to supply a first signal to the plurality of first electrodes or rods in order to resonantly or parametrically excite undesired ions within or from the first ion guide or mass filter device, wherein the first signal also comprises a plurality of frequency notches; and then (ii) to supply a second different signal to the plurality of first electrodes or rods in order to resonantly or parametrically excite undesired ions within or from the first ion guide or mass filter device, wherein the second signal also comprises a plurality of frequency notches;

wherein the second ion guide or mass filter device comprises:

(a) a second plurality of electrodes or rods;

(b) a second AC or RF voltage supply for supplying a second AC or RF voltage to the second plurality of electrodes or rods; and (c) a signal means arranged and adapted: (i) to supply a third signal to the plurality of second electrodes or rods in order to resonantly or parametrically excite undesired ions within or from the second ion guide or mass filter device, wherein the third signal also comprises a plurality of frequency notches, and wherein a first set of data is obtained; and then (ii) to supply a fourth different signal to the plurality of second electrodes or rods in order to resonantly or parametrically excite undesired ions within or from the second ion guide or mass filter device, wherein the fourth signal also comprises a plurality of frequency notches, and wherein a second set of data is obtained; and a device for deconvoluting, decoding or demodulating the first set of data and/or the second set of data to determine the intensity of ions having a plurality of different mass to charge ratios.

An ion detector or a mass analyzer is preferably provided downstream of the second ion guide or mass filter device. The mass analyzer is preferably selected from the group consisting of: (i) a quadrupole mass analyzer; (ii) a 2D or linear quadrupole mass analyzer; (iii) a Paul or 3D quadrupole mass analyzer; (iv) a Penning trap mass analyzer; (v) an ion trap mass analyzer; (vi) a magnetic sector mass analyzer; (vii) Ion Cyclotron Resonance ("ICR") mass analyzer; (viii) a Fourier Transform Ion Cyclotron Resonance ("FTICR") mass analyzer; (ix) an electrostatic or orbitrap mass analyzer; (x) a Fourier Transform electrostatic or orbitrap mass analyzer; (xi) a Fourier Transform mass analyzer; (xii) a Time of Flight mass analyzer; (xiii) an orthogonal acceleration Time of Flight mass analyzer; and (xiv) a linear acceleration Time of Flight mass analyzer.

An ion source is preferably provided and is preferably selected from the group of ion sources referred to above. The collision, fragmentation or reaction device is preferably selected from the group consisting of: (i) a Collisional Induced Dissociation ("CID") fragmentation device; (ii) a Surface Induced Dissociation ("SID") fragmentation device; (iii) an Electron Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions. A Collisional Induced Dissociation ("CID") fragmentation device is particularly preferred.

According to another aspect of the present invention there is provided a method comprising:

providing a first ion guide or mass filter device comprising a first plurality of electrodes or rods;

providing a collision, fragmentation or reaction device downstream of the first, ion guide or mass filter device;

providing a second ion guide or mass filter device downstream of the collision, fragmentation or reaction device, wherein the second ion guide or mass filter device comprises a second plurality of electrodes or rods;

supplying a first AC or RF voltage supply to the first plurality of electrodes or rods;

supplying a first signal to the plurality of first electrodes or rods in order to resonantly or parametrically excite undesired ions within or from the first ion guide or mass filter device, wherein the first signal also comprises a plurality of frequency notches; and then supplying a second different signal to the plurality of first electrodes or rods in order to resonantly or parametrically excite undesired ions within or from the first ion guide or mass filter device, wherein the second signal also comprises a plurality of frequency notches;

supplying a second AC or RF voltage supply to the second plurality of electrodes or rods;

supplying a third signal to the plurality of second electrodes or rods in order to resonantly or parametrically excite undesired ions within or from the second ion guide or mass filter device, wherein the third signal also comprises a plurality of frequency notches, and obtaining a first set of data; and then supplying a fourth different signal to the plurality of second electrodes or rods in order to resonantly or parametrically excite undesired ions within or from the second ion guide or mass filter device, wherein the fourth signal also comprises a plurality of frequency notches, and obtaining a second set of data; and deconvoluting, decoding or demodulating the first set of data and/or the second set of data to determine the intensity of ions having a plurality of different mass to charge ratios.

An ion detector or a mass analyzer is preferably provided downstream of the second ion guide or mass filter device. The mass analyzer is preferably selected from the group consisting of: (i) a quadrupole mass analyzer; (ii) a 2D or linear quadrupole mass analyzer; (iii) a Paul or 3D quadrupole mass analyzer; (iv) a Penning trap mass analyzer; (v) an ion trap mass analyzer; (vi) a magnetic sector mass analyzer; (vii) Ion Cyclotron Resonance ("ICR") mass analyzer; (viii) a Fourier Transform Ion Cyclotron Resonance ("FTICR") mass analyzer; (ix) an electrostatic or orbitrap mass analyzer; (x) a Fourier Transform electrostatic or orbitrap mass analyzer; (xi) a Fourier Transform mass analyzer; (xii) a Time of Flight mass analyzer; (xiii) an orthogonal acceleration Time of Flight mass analyzer; and (xiv) a linear acceleration Time of Flight mass analyzer.

An ion source is preferably provided and is preferably selected from the group of ion sources referred to above. The collision, fragmentation or reaction device is preferably selected from the group consisting of: (i) a Collisional Induced Dissociation ("CID") fragmentation device; (ii) a Surface Induced Dissociation ("SID") fragmentation device; (iii) an Electron Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions. A Collisional Induced Dissociation ("CID") fragmentation device is particularly preferred.

According to another aspect of the present invention a method of generating a broadband signal comprising:

synthesising a spectrum of frequencies, wherein the frequencies are preferably substantially coherent;

at a first time t1 filtering out, substantially removing or attenuating or omitting a first plurality of frequencies or frequency components;

at a second later time t2 filtering out, substantially removing or attenuating or omitting a second different plurality of frequencies or frequency components;

wherein the time delay t2-t1 is selected from the group consisting of: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; (xxxi) 30-40 ms; (xxvii) 40-50 ms; (xxxiii) 50-60 ms; (xxxiv) 60-70 ms; (xxxv) 70-80 ms; (xxxvi) 80-90 ms; (xxxvii) 90-100 ms; (xxxviii) 100-200 ms; (xxxix) 200-300 ms; (xl) 300-400 ms; (xli) 400-500 ms; (xlii) 500-600 ms; (xliii) 600-700 ms; (xliv) 700-800 ms; (xlv) 800-900; (xlvi) 900-1000 ms; and (xlvii) >1 s.

According to the preferred embodiment the time delay t2-t1 is preferably in the range 1-20 ms, further preferably 1-10 ms. The method further preferably comprises applying the broadband signal which has been synthesised to an ion guide or mass filter device as described above and which preferably forms part of a mass spectrometer according to any of the above described embodiments.

According to another aspect of the present invention there is provided apparatus for generating a broadband signal comprising:

a synthesiser for synthesising a spectrum of frequencies, wherein the frequencies are preferably substantially coherent;

a device arranged and adapted to filter out, substantially remove or attenuate or omit a first plurality of frequencies or frequency components at a first time t1; and a device arranged and adapted to filter out, substantially remove or attenuate or omit a second different plurality of frequencies or frequency components at a second later time t2;

wherein the time delay t2-t1 is selected from the group consisting of: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; (xxxi) 30-40 ms; (xxxii) 40-50 ms; (xxxiii) 50-60 ms; (xxxiv) 60-70 ms; (xxxv) 70-80 ms; (xxxvi) 80-90 ms; (xxxvii) 90-100 ms; (xxxviii) 100-200 ms; (xxxix) 200-300 ms; (xl) 300-400 ms; (xli) 400-500 ms; (xlii) 500-600 ms; (xliii) 600-700 ms; (xliv) 700-800 ms; (xlv) 800-900; (xlvi) 900-1000 ms; and (xlvii) >1 s.

According to the preferred embodiment the time delay t2-t1 is preferably in the range 1-20 ms, further preferably 1-10 ms. The method further preferably comprises applying the broadband signal which has been synthesised to an ion guide or mass filter device as described above and which preferably forms part of a mass spectrometer according to any of the above described embodiments.

The preferred embodiments described further above are equally applicable to the method and apparatus for generating a broadband signal as described immediately above.

The preferred embodiment relates to an ion guide or mass filter device, a mass spectrometer, a method of guiding or mass filtering ions and a method of mass spectrometry. The preferred embodiment relates, in particular, to a quadrupole rod set ion guide wherein a notched broadband frequency signal is preferably applied to the rods of the quadrupole rod set ion guide. The notched broadband frequency signal is preferably applied in such a manner so as to allow analyte ions present in the ion guide to be transmitted through the ion guide whilst substantially removing, by resonant or parametric excitation and radial ejection, unselected or undesired ions. The notched broadband frequency signal is preferably frequency modulated in a known and predetermined manner such that ions of interest are either transmitted or ejected according to a modulation pattern. At any given time a plurality of ion species are preferably transmitted and may be simultaneously detected. The modulated detector output is preferably deconvoluted or decoded using the knowledge of the modulation pattern. This arrangement preferably allows for a greatly enhanced efficiency or duty cycle above and beyond that provided using conventional arrangements.

According to an embodiment there is provided an ion guide or mass filter device comprising: a multipole rod set; a first AC or RF voltage supply for supplying an AC or RF voltage between adjacent rods of the multipole rod set; a second AC voltage or signal means arranged and adapted to supply a signal to the plurality of electrodes or rods in order to resonantly or parametrically excite undesired ions within or from the ion guide or mass filter device; and a means of modulating the second AC voltage or signal in a known, predetermined or predictable manner.

An AC or RF voltage applied to the plurality of electrodes or rods in order to confine ions within the preferred ion guide or mass filter device preferably comprises a first AC or RF voltage. The signal applied to the plurality of electrodes or rods in order to resonantly or parametrically excite ions within or from the ion guide or mass filter device preferably comprises a second different AC voltage.

The signal means is preferably arranged and adapted to radially eject undesired ions from the ion guide or mass filter device. The ion guide or mass filter device is preferably arranged and adapted to onwardly transmit ions without substantially confining or trapping ions axially within the ion guide or mass filter device i.e. the ion guide or mass filter device is different from an ion trap wherein ions are confined axially within the ion trap.

The ion guide or mass filter device preferably comprises a quadrupole ion guide or mass filter device. The quadrupole ion guide or mass filter device preferably comprises a quadrupole rod set comprising four rods. Each rod of the quadrupole rod set preferably has a longitudinal axis and the longitudinal axes of each of the four rods are preferably substantially parallel to one another. The rods are preferably also equidistant to one another. The ion guide or mass filter device is preferably arranged to maintain a radial quadratic potential distribution or a radial linear electric field. In addition, a DC voltage may be applied between adjacent rods thereby imposing a mass to charge ratio window of transmission of ions with settable high and low mass cut-offs for the transmission of ions.

The signal means is preferably arranged and adapted to supply a broadband frequency signal to the plurality of electrodes or rods comprising the preferred ion guide or mass filter device.

The signal means is preferably arranged and adapted to supply a signal having a dipolar and/or a quadrupolar waveform. A dipolar waveform signal is preferably applied between two opposing rods and the signal preferably has a plurality of frequency components which preferably correspond with the secular, resonance, first or fundamental harmonic frequency of a plurality of ions received in use by the preferred ion guide or mass filter device. Alternatively, or in addition, a quadrupolar waveform signal may be applied between adjacent rods. The quadrupolar waveform signal preferably has a plurality of frequency components which preferably correspond with a multiple or sub-multiple of the secular, resonance, first or fundamental harmonic frequency of a plurality of ions received in use by the preferred ion guide or mass filter device. The quadrupolar waveform signal is preferably arranged and adapted to have a plurality of frequency components which preferably correspond to twice the secular, resonance, first or fundamental harmonic frequency of a plurality of ions received in use by the preferred ion guide or mass filter device.

The signal means is preferably arranged and adapted to supply a signal having two or more frequency notches. Dependent upon the mode of operation, the signal which is supplied preferably comprises at least two, and preferably more, frequency notches. The two or more frequency notches preferably correspond with the secular, resonance, first or fundamental harmonic frequencies, or a multiple or sub-multiple thereof, of one or more ions or species of ions which are desired to be transmitted by the preferred ion guide or mass filter device.

The signal means is preferably arranged and adapted to cause the preferred ion guide or mass filter device to have one or a plurality of discrete or separate simultaneous mass to charge ratio transmission windows such that an ion having a mass to charge ratio falling within a mass to charge ratio transmission window will be onwardly transmitted by the preferred ion guide or mass filter device and such that an ion having a mass to charge ratio falling outside of a mass to charge ratio transmission window will preferably be resonantly or parametrically excited and ejected from the preferred ion guide or mass filter device.

The signal means is preferably arranged and adapted to cause the ion guide or mass filter device to have at least two and more preferably more than two discrete or separate simultaneous mass to charge ratio transmission windows. The discrete or separate simultaneous mass to charge ratio transmission windows are preferably substantially non-overlapping and/or non-continuous. Ions having mass to charge ratios intermediate two neighbouring mass to charge ratio transmission windows are preferably resonantly or parametrically excited and ejected from the preferred ion guide or mass filter device.

According to an embodiment in a first mode of operation substantially all of the electrodes or rods are preferably maintained at substantially the same DC potential or voltage. According to this embodiment the ion guide or mass filter device is preferably operated in a substantially non-resolving or ion-guiding only mode of operation.

According to an embodiment the second AC signal means is preferably arranged and adapted to apply the signal to opposed or non-adjacent electrodes or rods of the preferred ion guide or mass filter device.

According to another embodiment the second AC signal means is preferably arranged and adapted to apply the signal to adjacent electrodes or rods of the preferred ion guide or mass filter device.

According to the preferred embodiment the centre or middle and/or width of any of the given mass to charge ratio transmission windows preferably remains substantially constant over at least a minimum time period. The minimum time period is preferably the time of flight through the preferred device (and any subsequent elements) of ions having mass to charge ratios corresponding with the highest mass to charge transmission window or ion selected.

According to an embodiment a modulating pattern applied to the second AC signal means preferably repeats at least once, preferably many times during a given acquisition cycle.

According to the preferred embodiment the modulating pattern applied to the signal means preferably results in a given mass to charge ratio transmission window being active or in a transmitting mode for at least X % of the acquisition period, where X is (i) >1 (ii) >2 (ii) >5 (iii) >10 (iv) >20 (v) >30 (vi) >40 (vii) >50 (viii) >60 (ix) >70 (x) >80 (xi) >90.

According to an embodiment the modulating pattern applied to the second AC signal means preferably has at least the same number of discrete patterns as the number of mass to charge ratio transmission windows selected.

According to another embodiment the modulating pattern applied to the second AC signal means preferably has a greater number of discrete patterns as the number of mass to charge ratio transmission window selected.

According to an embodiment the modulating pattern applied to the second AC signal means may be provided or controlled by a pseudo-random number generator.

According to an embodiment the modulating pattern applied to the second AC signal means may be provided by a wavelet based modulation technique.

According to an embodiment the modulating pattern applied to the second AC signal means may result in each mass to charge ratio transmission window being modulated with a unique and independent frequency.

According to an embodiment the modulating pattern applied to the second AC signal means may take into consideration the time of flight of the ions through the device.

There are many such other schemes of modulation not described here that one skilled in the art may use.

According to an embodiment the modulated detector signal may be deconvoluted or decoded using a phase locked amplifier.

According to an embodiment the modulated detector signal may be deconvoluted or decoded using a neural network.

According to an embodiment the Modulated detector signal may be deconvoluted or decoded using a software or firmware based deconvolution or decoding routine.

According to an embodiment the modulated detector signal may be deconvoluted or decoded using by a wavelet based demodulation technique.

According to an embodiment the modulated detector signal may be deconvoluted or decoded using an algorithm that takes into consideration the time of flight of the ions through the device.

Various other schemes of demodulation or deconvolution or decoding may be used.

According to another aspect of the present invention there is provided a mass spectrometer comprising an ion guide or mass filter device as described above. The mass spectrometer preferably further comprises a collision, fragmentation or reaction device arranged upstream and/or downstream of the preferred ion guide or mass filter device. The collision, fragmentation or reaction device preferably comprises: (i) a multipole rod set or a segmented multipole rod set; (ii) an ion tunnel or ion funnel; or (iii) a stack or array of planar, plate or mesh electrodes. The multipole rod set preferably comprises a quadrupole rod set, a hexapole rod set, an octapole rod set or a rod set comprising more than eight rods.

The mass spectrometer preferably further comprises an ion source. The ion source is preferably selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

The ion source may comprise a pulsed or continuous ion source.

The mass spectrometer preferably further comprises an additional mass analyzer or mass analyzers. The mass analyzer or analyzers are preferably selected from the group consisting of: (i) a quadrupole mass analyzer; (ii) a 2D or linear quadrupole mass analyzer; (iii) a Paul or 3D quadrupole mass analyzer; (iv) a Penning trap mass analyzer; (v) an ion trap mass analyzer; (vi) a magnetic sector mass analyzer; (vii) Ion Cyclotron Resonance ("ICR") mass analyzer; (viii) a Fourier Transform Ion Cyclotron Resonance ("FTICR") mass analyzer; (ix) a Fourier Transform electrostatic ion trap ("orbitrap") mass analyzer. According to another embodiment the mass analyzer(s) may comprise one or more Time of Flight mass analyzer(s). For example, an orthogonal acceleration or linear acceleration Time of Flight mass analyzer may be provided.

According to the preferred embodiment the mass spectrometer preferably comprises a means of detecting positively charged and negatively charged ions or an ion detector.

Various embodiments of the present invention together with arrangements given for illustrative purposes only will now be described, by way of example only, and with reference to the accompanying drawings in which.

Figure 5:
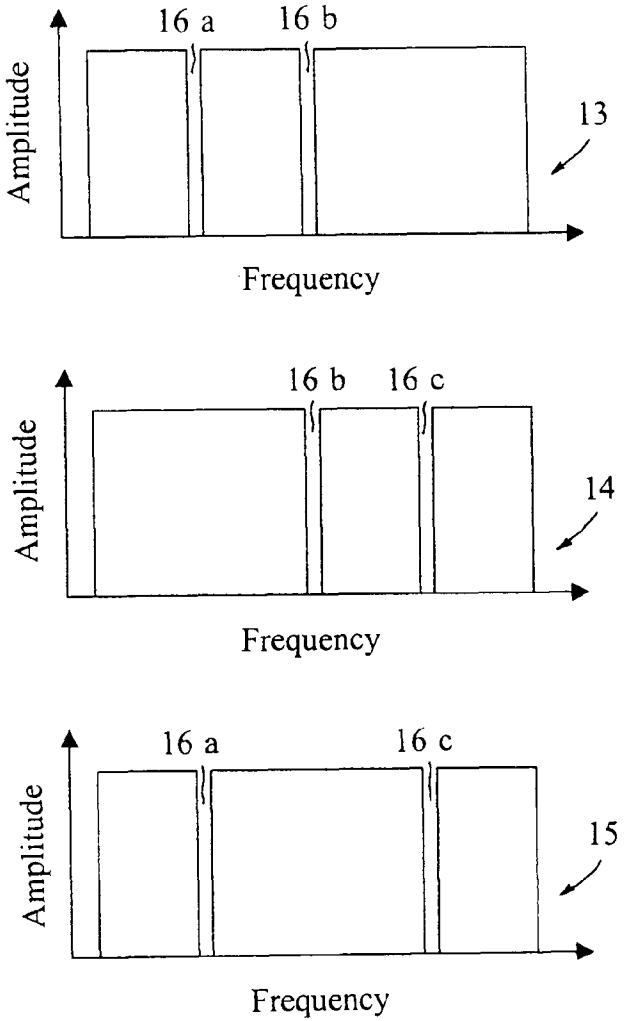
FIGS. 5A-5C show a schematic representation of a set of modulated notched broadband signals that may be applied sequentially to two opposed rods of a quadrupole rod set according to a preferred embodiment of the present invention wherein, in this example, ion signals corresponding with three mass to charge ratio transmission windows are deconvoluted.
Figures 6A, 6B, 6C, 6D:
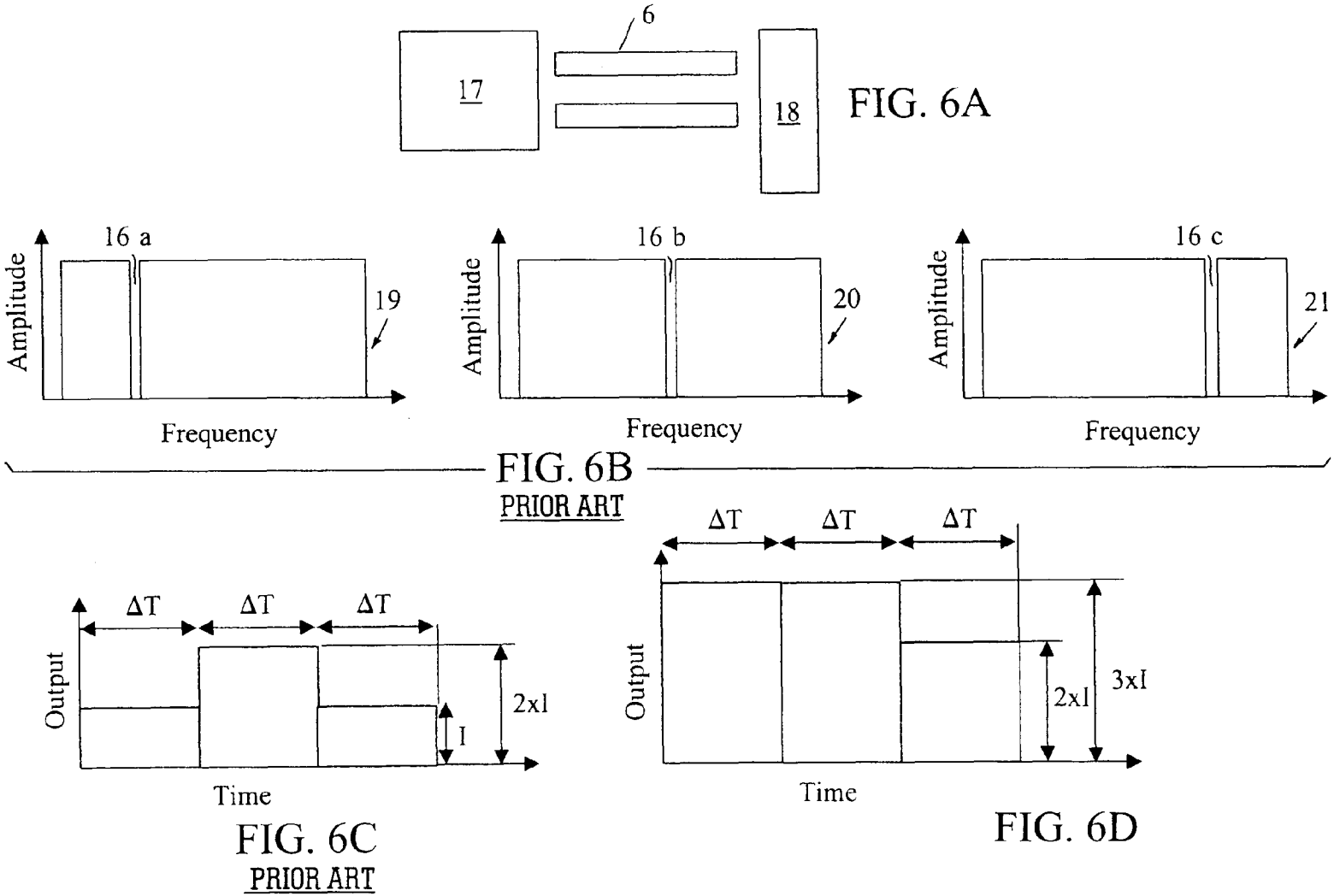
FIG. 6B PRIOR ART
FIG. 6C PRIOR ART
Figure 7A:
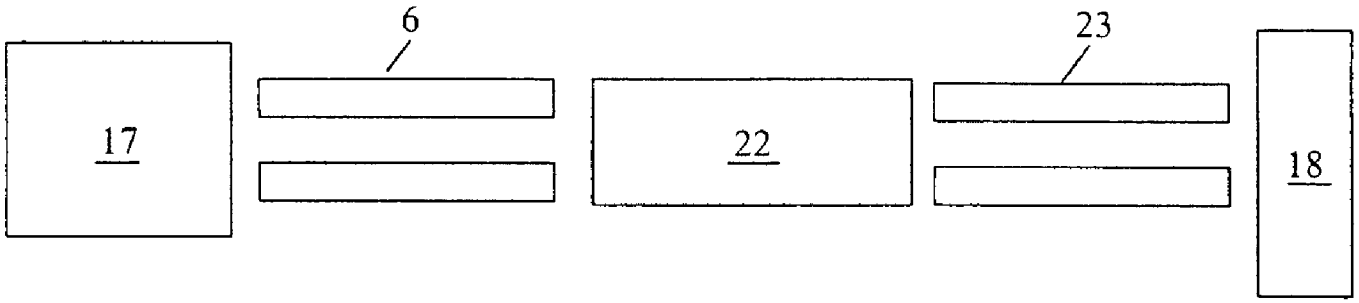
Figure 7B:
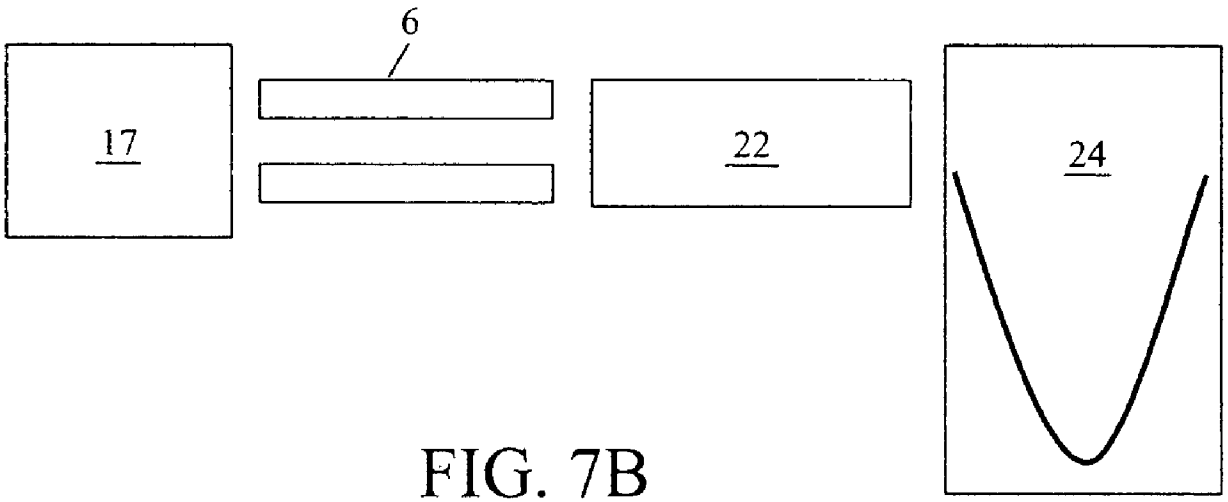

FIG. 6A shows a schematic representation of a preferred ion guide or mass filter device arranged between an ion source and an ion detector to form a simple mass spectrometer, FIG. 6B shows a representation of a notched broadband frequency signal which may be applied conventionally to two opposed rods of a quadrupole rod set to transmit ions having a single mass to charge ratio at any given time, FIG. 6C a schematic representation of the output signal produced in a conventional manner when the notched broadband frequency signals shown in FIG. 6B are applied to a quadrupole rod set and FIG. 6D shows the improved output signal which may be produced when notched broadband frequency signals such as shown in FIG. 5 are applied to a quadrupole rod set; and FIG. 7A shows two preferred ion guides or mass filter devices utilised in a tandem quadrupole (triple quadrupole) type mass spectrometer geometry and FIG. 7B shows a preferred ion guide or mass filter device utilised in a tandem quadrupole Time of Flight mass spectrometer geometry.

Figure 1:
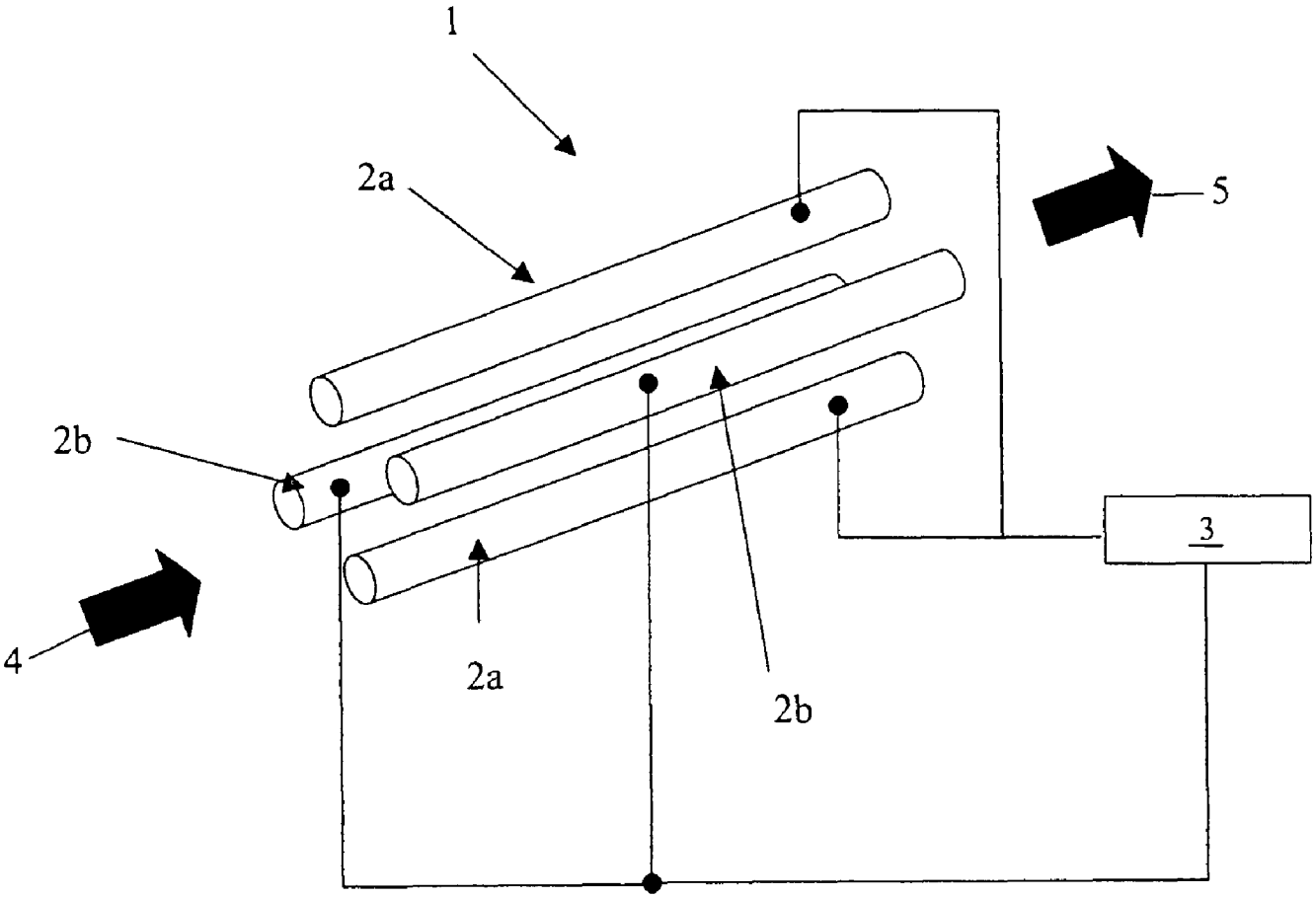
FIG. 1 PRIOR ART
FIG. 1 shows a conventional quadrupole rod set ion guide.

A conventional quadrupole rod set ion guide 1 is shown in FIG. 1. The quadrupole rod set comprises four parallel rods 2*a*,2*b*. All four rods 2*a*,2*b* are maintained at substantially the same DC voltage or potential. A two phase RF voltage supply 3 is connected to or supplied to the rods 2*a*,2*b* such that adjacent rods have opposite phases of an RF voltage applied to them whilst diametrically opposed rods 2*a*; 2*b* have the same phase RF voltage applied to them. The RF voltage applied to the rods 2*a*,2*b* creates a pseudo-potential valley which acts to confine ions radially within the ion guide. In this configuration ions are not confined axially within the ion guide.

The conventional RF only quadrupole ion guide 1 as shown in FIG. 1 transmits substantially all the ions received at the entrance to the ion guide simultaneously. The quadrupole rod set 1 may alternatively be operated as a mass filter or mass analyzer by maintaining a DC potential difference between adjacent rods. When operated as a mass filter or mass analyzer only ions which have mass to charge ratios which fall within a certain mass to charge ratio transmission window will have stable trajectories and are transmitted through the mass filter. Ions having mass to charge ratios which fall outside the mass to charge ratio transmission window will have unstable trajectories and will be ejected from the mass filter and will be lost to the system.

Figure 2:
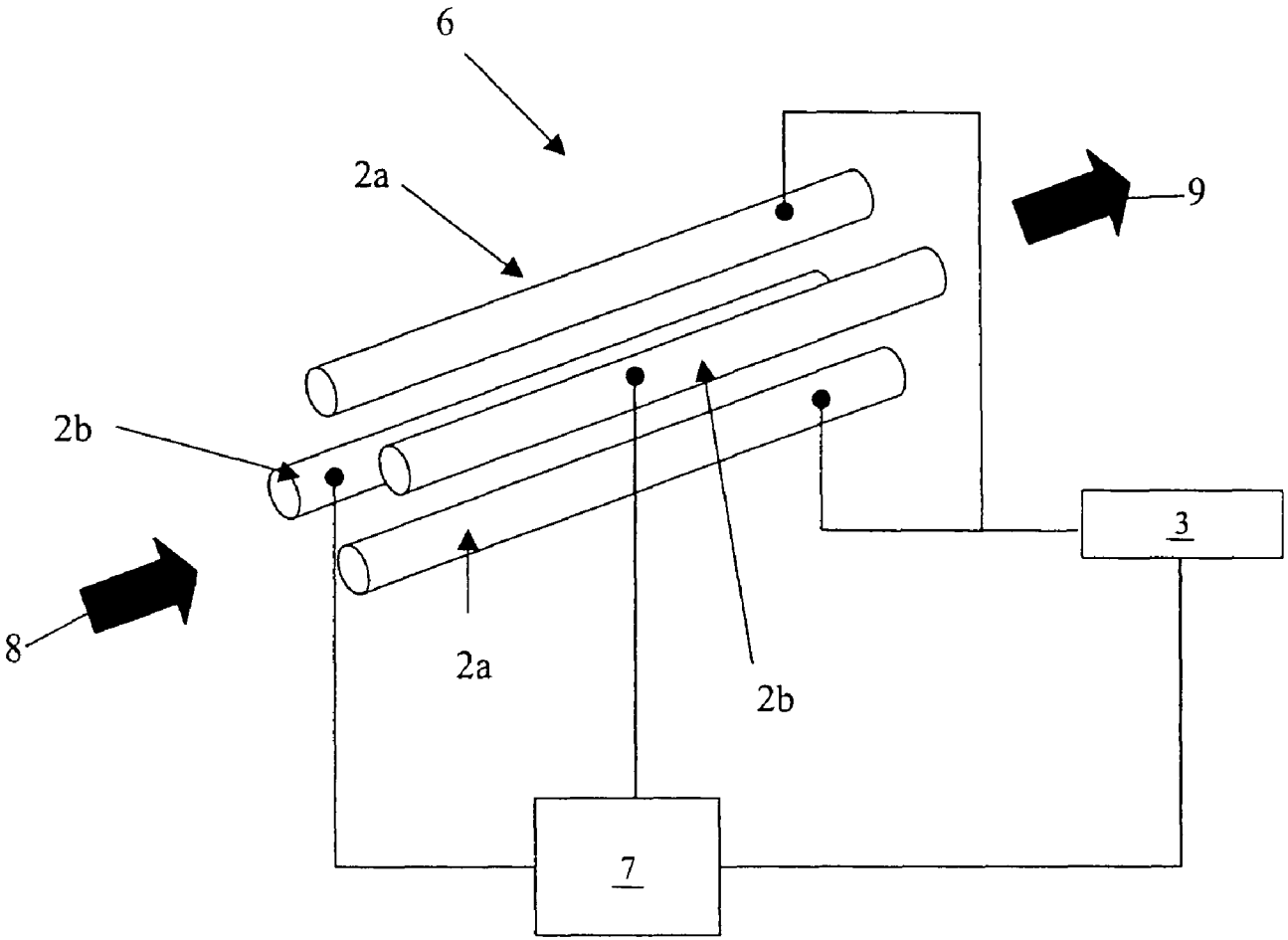
FIG. 2 PRIOR ART
FIG. 2 shows an ion guide or mass filter device operated in a known manner wherein a notched broadband frequency signal is applied to two opposed rods in order to resonantly excite and radially eject undesired ions.

Another known quadrupole ion guide or mass filter device 6 is shown in FIG. 2. According to this arrangement a notched broadband frequency signal 7 is applied to an opposed pair of rods 2*a*; 2*b*. The notched broadband frequency signal 7 comprises an AC waveform. The application of a broadband frequency signal 7 to an opposed pair of rods 2*a*,2*b* causes undesired ions to be resonantly excited and radially ejected from the ion guide or mass filter device.

The frequency notches provided in the broadband frequency signal 7 are arranged such that some frequencies or frequency components are absent or otherwise missing from the broadband frequency signal. Ions having resonance or first harmonic frequencies which substantially correspond with the absent or missing frequencies in the applied broadband frequency signal 7 will not therefore be resonantly excited. Accordingly, these ions will not be ejected by the applied broadband frequency signal and hence these ions will be substantially unaffected by the application of the broadband frequency signal 7 to the rods 2*a*,2*b*. These ions will therefore be transmitted onwardly by the ion guide or mass filter device.

Figure 3:
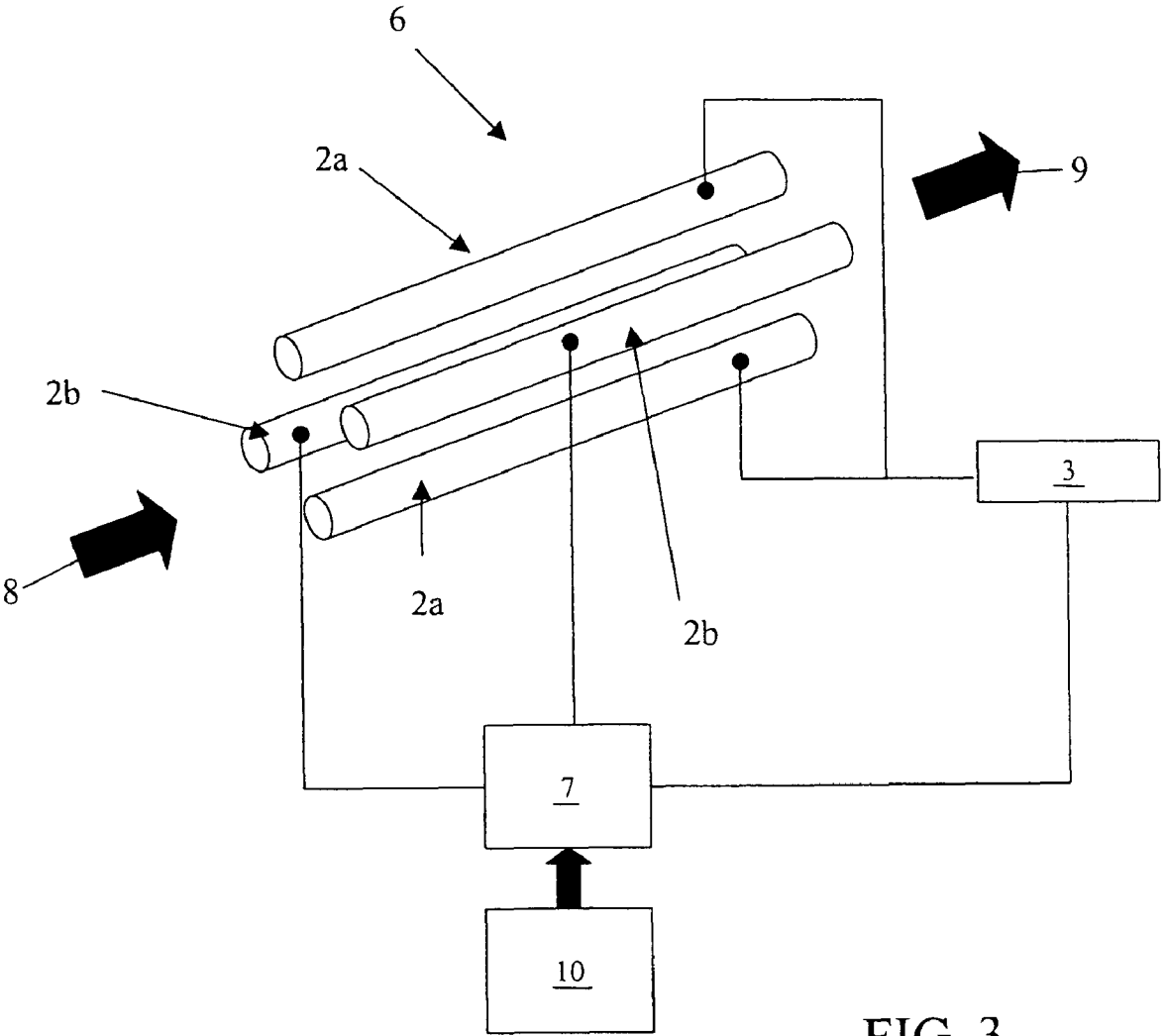
FIG. 3 shows an ion guide or mass filter device according to a preferred embodiment of the present invention wherein a modulated notched broadband frequency signal is applied to two opposed rods in order to resonantly excite and radially eject ions in a time modulated or varying manner.

An ion guide or mass filter device 6 according to a preferred embodiment of the present invention is shown in FIG. 3. The ion guide or mass filter device 6 preferably comprises a quadrupole rod set comprising four parallel rods 2*a*,2*b* and is similar to a conventional quadrupole rod set as shown in FIG. 2. A notched broadband frequency signal 7 is preferably applied to an opposed pair of rods 2*a*,2*b*. However, according to the preferred embodiment the application or inclusion of frequency notches or missing frequencies is preferably determined by a modulation device or controller 10.

Ions which are desired to be onwardly transmitted by the preferred ion guide or mass filter device 6 and which are substantially unaffected by the application of the notched broadband frequency signal constitute a subset or reduced set of the ions 8 received at the entrance to the ion guide or mass filter device 6.

Figure 4:
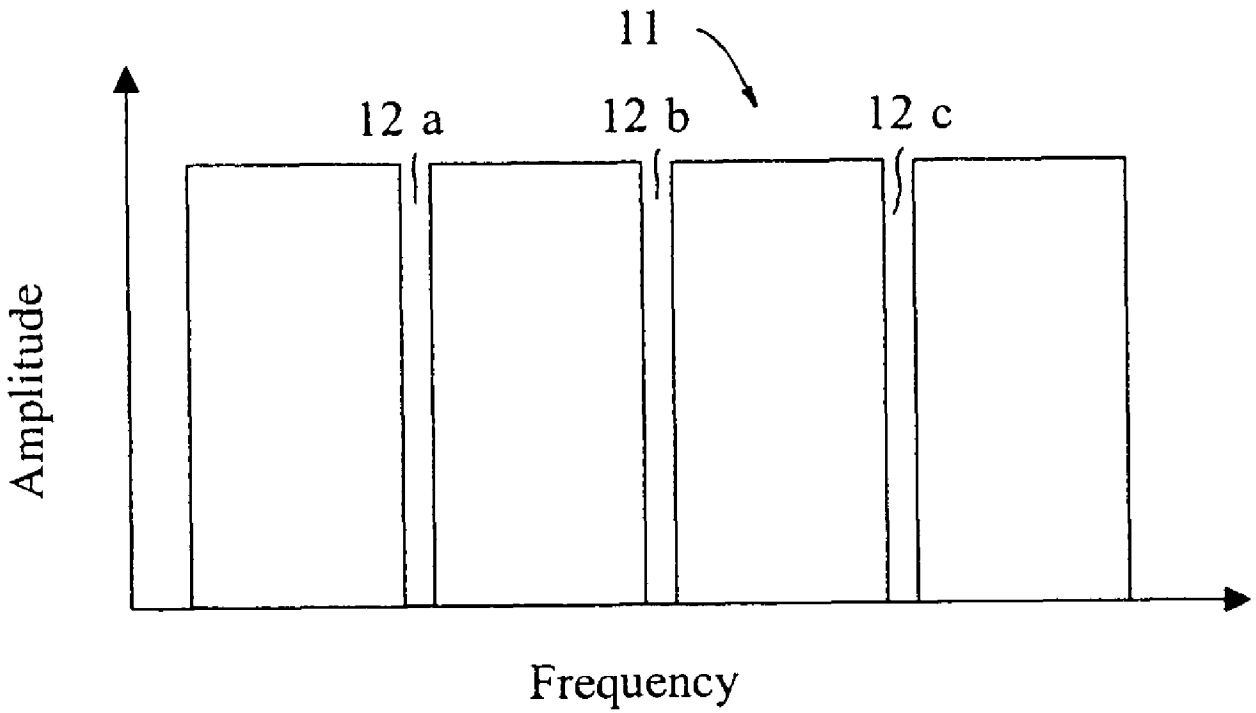
FIG. 4 PRIOR ART
FIG. 4 shows a schematic representation of a notched broadband frequency signal which may be applied conventionally to two opposed rods of a quadrupole rod set.

A conventional notched broadband frequency signal 11 is shown in FIG. 4. The conventional notched broadband frequency signal 11 may have, for example, three frequency notches 12*a*,12*b*,12*c*. In this illustration the overall range of mass to charge ratio values transmitted by the ion guide or mass filter has also been restricted by the application of a DC voltage between adjacent rods. Accordingly, all the ions received into the ion guide or mass filter will be resonantly excited and radially ejected from the ion guide or mass filter device except for those ions having resonance frequencies which correspond with one of the frequency notches 12*a*; 12*b*; 12*c*. Ions having a mass to charge ratio which corresponds with one of the frequency notches 12*a*; 12*b*; 12*c* will not be radially ejected from the ion guide or mass filter device and hence will be transmitted onwardly to the exit of the ion guide or mass filter device.

With reference to FIG. 3, the subset of ions 9 which are transmitted onwardly through the ion guide or mass filter device 6 will exit the ion guide or mass filter device 6 and may be detected by an ion detector (not shown). Alternatively, the ions may be transmitted to another device or component of a mass spectrometer. If the subset of ions 9 is transmitted directly to an ion detector then the relative intensities of each component of the subset of ions 9 may be determined.

FIG. 5 shows an example of a series of three different notched broadband frequency signals 13,14,15 which may be applied sequentially to an ion guide or mass filter device 6 according to a preferred embodiment of the present invention. The three notched broadband frequency signals 13,14,15 preferably each have two of three different frequency notches 16*a*,16*b*,16*c*. The three frequency notches 16*a*,16*b*,16*c* preferably correspond to three mass to charge ratio windows ΔM1, ΔM2 and ΔM3 which are each preferably centered at three mass to charge ratios M1, M2 and M3 respectively. A different combination of two of the three frequency notches 16*a*,16*b*,16*c* is preferably provided in each of the three broadband frequency signals 13,14,15. The pattern of frequency notches present in each signal is preferably predetermined and provided by the modulation controller device 10.

The overall range of each of the three broadband frequency signals 13,14,15 is preferably sufficiently wide such that preferably all undesired ions present in an ion beam 8 which is preferably received by the preferred ion guide or mass filter device 6 will be radially ejected whilst at least some of the analyte ions of interest will be substantially retained and transmitted. For each broadband frequency signal 13; 14; 15 the set of mass to charge ratios for which ions are onwardly transmitted preferably constitutes a subset of all the mass to charge ratios of ions of interest.

According to the preferred embodiment each of the three broadband frequency signals 13,14,15 is preferably applied for a substantially constant time period which is preferably sufficient to allow at least some of those ions in the subset of ions with the largest mass to charge ratio to traverse the preferred ion guide or mass filter device 6 and to reach an ion detector which is preferably arranged downstream of the preferred ion guide or mass filter device 6.

According to an embodiment the preferred ion guide or mass filter device 6 may be provided or located downstream of an ion source 17 and upstream of an ion detector 18 as shown in FIG. 6A.

For the purposes of illustration only, an experiment will now be considered wherein three analyte ions of interest having mass to charge ratios M1, M2 and M3 are desired to be measured. According to the known approach, a quadrupole rod set mass filter 6 might be arranged to cycle through a sequence of three different settings such that ions with each of the three different mass to charge ratio values M1, M2 and M3 are transmitted sequentially to the ion detector. If the time spent at each setting is the same, then ions of each mass to charge ratio will be transmitted for an equal period of time and hence for substantially one third of the total measurement time.

According to the known approach the notched broadband frequency signals as illustrated in FIG. 6B may be applied sequentially to the quadrupole rod set ion guide 6. The frequency notches 16*a*,16*b*,16*c* correspond to the three mass to charge ratio windows ΔM1, ΔM2 and ΔM3 which are each centered around the three mass to charge ratios M1, M2 and M3 respectively. Each of the three separate notched broadband frequency signals 19,20,21 includes a single frequency notch 16*a*; 16*b*; 16*c* and each notched broadband frequency signal may be applied for a constant time period ΔT. The output from the ion detector resulting from the application of the three different notched broadband frequency signals 19,20,21 in sequence may be, for example, as shown in FIG. 6C. Here the intensity of the signal for M1 is $I_{M1}$, the intensity of the signal for M2 is $I_{M2}$ and the intensity of the signal for M3 is $I_{M3}$, where $I_{M1}$=I, $I_{M2}$=2I and $I_{M3}$=I. Ions having each mass to charge ratio are transmitted for an equal period of time and for substantially one third of the total measurement time.

According to the preferred embodiment instead of sequentially applying the broadband frequency signals as shown in FIG. 6B which each have a single frequency notch, the broadband frequency signals 13,14,15 as shown in FIG. 5 which each have two frequency notches are preferably applied in sequence. According to the preferred embodiment the output signal will now be that as shown in FIG. 6D. The output signal shown in FIG. 6D is preferably deconvoluted or decoded using the following three simultaneous equations:

$$I_{M1}+I_{M2}=3I \quad (3)$$

$$I_{M2}+I_{M3}=3I \quad (4)$$

$$I_{M1}+I_{M3}=2I \quad (5)$$

These three simultaneous equations may be solved to give the correct signal intensities of $I_{M1}$=I, $I_{M2}$=2I and $I_{M3}$=I. Ions at each mass to charge ratio are transmitted for an equal period of time as is the case with the conventional approach. However, according to the preferred embodiment ions at each mass to charge ratio are advantageously transmitted for substantially two thirds of the total measurement time.

In this example, wherein according to the preferred embodiment each notched broadband frequency signal 13; 14; 15 comprises two frequency notches 16*a*; 16*b*; 16*c*, the duty cycle or integrated signal has increased by a factor of ×2 compared with the conventional approach wherein only one frequency notch 16*a*; 16*b*; 16*c* was applied at any one time. The preferred embodiment similarly exhibits a duty cycle or integrated signal enhancement of a factor of ×2 compared with a conventional arrangement wherein a conventional quadrupole rod set mass filter transmits ions at each mass to charge ratio sequentially.

If more than three analyte ions having different mass to charge ratios are desired to be measured, and the notched broadband frequency signals which are applied according to the preferred embodiment include more than two frequency notches, then the overall increase in signal relative to that recorded using a conventional arrangement is even greater. For example, if four co-eluting compounds are desired to be measured then according to the preferred embodiment the duty cycle and sensitivity will be increased by a factor of ×2 if two frequency notches are applied simultaneously. The duty cycle will be increased by a factor ×3 if three frequency notches are applied simultaneously. Similarly, if five co-eluting compounds are desired to be measured then according to the preferred embodiment the duty cycle and sensitivity will be increased by a factor ×2 if two frequency notches are applied simultaneously, by a factor of ×3 if three frequency notches are applied simultaneously and by a factor of ×4 if four frequency notches are applied simultaneously.

More generally, if an experiment is performed to monitor different target compounds and the number of compounds desired to be monitored at any one time is Nc then according to the preferred embodiment the maximum number of frequency notches that are preferably applied simultaneously is (Nc-1). If equal time is spent in acquiring data for each applied notched broadband frequency signal then the gain in duty cycle and sensitivity compared to the duty cycle obtainable by using a quadrupole rod mass filter operating in a conventional mode of operation is equal to the number of frequency notches.

The principles of the preferred embodiment may be extended so that a full mass spectrum may be obtained. For example, if a mass spectrum is desired to be measured over a mass to charge ratio range of 100 to 900 (i.e. over a total mass range of 800 mass units) and a notched broadband frequency signal is applied which comprises 400 frequency notches in a manner according to the preferred embodiment as described above each spanning one mass unit, then the gain in signal intensity over that obtainable by scanning a conventional quadrupole rod set mass filter in a conventional manner may be as high as a factor ×400.

In practice, the potential gain which may be afforded by the approach according to the preferred embodiment may be reduced as a consequence of the need to wait for ions having the highest mass to charge ratio in each subset to traverse the length of the ion guide or mass filter. For example, an ion having a mass to charge ratio of 900 will take approximately 0.43 ms to travel the length of an ion guide or mass filter device which has a length of 20 cm assuming that the ion has 1 eV of kinetic energy. If data acquisition commences after waiting for 0.43 ms from applying a notched broadband frequency spectrum, and data is then acquired for a period 0.43 ms, the data acquisition duty cycle will be reduced by 50%. For the above example, where a spectrum is recorded over the mass to charge ratio range from 100 to 900, the overall gain in signal over that for a conventional arrangement is correspondingly reduced to substantially ×200. The acquisition time for this experiment would be 800 times each acquisition cycle of 0.86 ms i.e. 0.688 s.

The preferred embodiment, when applied to the acquisition of full mass spectra, in essence consists of subtracting the signal for ions with a number of specific mass to charge ratio values from the total signal applied across the full spectrum. This imposes a limit on the dynamic range of the resulting decoded spectrum. The achievable dynamic range will depend on the stability of the total signal and the greater the instability in the total signal the greater the restriction in the dynamic range. Hence in situations requiring more dynamic range it may be necessary to reduce the number of frequency notches in the applied broadband frequency signals thereby reducing the signal gain relative to the conventional arrangements. Nevertheless, the preferred embodiment will still provide a significant improvement in sensitivity compared with conventional arrangements.

According to an embodiment of the present invention, a mass spectrometer may be provided as shown in FIG. 7A wherein the mass spectrometer comprises an ion source 17, a first preferred ion guide or mass filter device 6, a collision, fragmentation or reaction device 22, a second preferred ion guide or mass filter device 23 and an ion detector 18. In this embodiment one or more parent ions may be selected by passing a group of ions through the first preferred ion guide or mass filter device 6. A first notched broadband frequency signal with two or more frequency notches as described above is preferably applied to the first preferred ion guide or mass filter device 6. The selected and onwardly transmitted parent ions may then preferably undergo fragmentation in the collision, fragmentation or reaction device 22 thereby yielding a plurality of daughter or fragment ions. Two or more daughter or fragment ions for each selected and transmitted parent ion may in turn be selected and transmitted through the second preferred ion guide or mass filter device 23 by applying a second notched broadband frequency signal with two or more frequency notches as described above to the second preferred ion guide or mass filter device 23. The second preferred ion guide or mass filter device 23 is preferably programmed to select and onwardly transmit only daughter ions of interest associated with the currently selected and transmitted parent ions.

This embodiment may be used, for example, to allow the simultaneous detection and quantification of more than one target compound when performing Multiple Reaction Monitoring ("MRM") experiments. This method of Simultaneous Multiple Reaction Monitoring or Parallel Multiple Reaction Monitoring ("SMRM" or "PMRM") overcomes the need to switch between different parent/daughter combinations, for example, during a chromatography separation experiment when screening for multiple co-eluting or partially co-eluting target compounds. Hence the preferred embodiment provides an improvement in the duty cycle and sensitivity of Multiple Reaction Monitoring (MRM) type experiments over that for a conventional triple quadrupole mass spectrometer.

The preferred embodiment allows two or more daughter or fragment ions for each parent ion to be monitored simultaneously. Measurement of the relative intensities of the two or more daughter or fragment ions may be required or used as a means of confirmation of the measurement of the target compound. The preferred embodiment allows a plurality of daughter or fragment ions to be measured with an increased duty cycle and sensitivity compared to that obtainable using a conventional triple quadrupole mass spectrometer.

Simultaneous or Parallel Multiple Reaction Monitoring experiments sometimes run the risk of interference from other co-eluting compounds which are not of interest. For example, an interfering co-eluting compound may have substantially the same parent ion mass to charge ratio as that of a first analyte ion of interest and may yield a daughter or fragment ion having substantially the same mass to charge ratio as that of a daughter or fragment ion which results from fragmenting a second different analyte ion of interest. However, if multiple daughter or fragment ions are measured for each parent ion of interest the presence of an interfering co-eluting compound can be recognized and discounted more easily according to the preferred embodiment.

By way of illustration, the analysis of four co-eluting parents ions by the method of Multiple Reaction Monitoring (MRM) will now be considered and will be compared with the method of Simultaneous or Parallel Multiple Reaction Monitoring (SMRM or PMRM). If it assumed that three daughter or fragment ions from each of four co-eluting parent ions are to be monitored by the method of Multiple Reaction Monitoring then the experiment will consist of switching through a sequence of twelve different parent/daughter ion mass combinations. If an equal amount of time is spent (i.e. according to a conventional approach) in acquiring data for each parent/daughter reaction combination then the sampling duty cycle for each reaction is 1 in 12 or 8.33%. If instead, a notched broadband frequency signal having three frequency notches is applied in a manner according to the preferred embodiment to the first quadrupole or mass filter device 6, such that at any one time three of the four different parent ions are onwardly transmitted in a substantially simultaneous manner, and a second notched broadband frequency signal having six frequency notches is applied to the second quadrupole or mass filter device 23 such as to transmit two of the three daughter or fragment ions of each of the three parent ions that are being transmitted through the first quadrupole or mass filter device 6, then the sampling duty cycle for each reaction is now 50%. This represents an increase by a factor of ×6 in the duty cycle and sensitivity.

A table of frequency notches is shown below which illustrates how different combinations of frequency notches may be applied to a first preferred ion guide or mass filter device (e.g. quadrupole) arranged upstream of a collision, fragmentation or reaction device and a second preferred ion guide or mass filter device (e.g. quadrupole) which is arranged downstream of the collision, fragmentation or reaction device. The different sequential combinations of frequency notches may be applied in order to execute the Simultaneous or Parallel Multiple Reaction Monitoring (SMRM or PMRM) experiment as described above. The table shows a sequence of 12 signals. For each signal the first quadrupole includes three frequency notches to allow transmission of three of the four different parent ions and the second quadrupole includes six frequency notches to allow transmission of two of the three fragment ions for each of the three parent ions transmitted through the first quadrupole. Each of the three fragment ions of each of the four parent ions is transmitted in six out of the twelve stages in each cycle and therefore for 50% of the time. The cycle of twelve sets of measurements allow the data to be decoded, deconvoluted or demodulated and thereby determine the intensity of each of the twelve fragment ions.

| Cycle | Parent | | | | Daughters of A | | | Daughters of B | | | Daughters of C | | | Daughters of D | | |
|---|---|---|---|---|---|---|---|---|---|---|---|---|---|---|---|---|
| No | $M_A$ | $M_B$ | $M_C$ | $M_D$ | $M_{A1}$ | $M_{A2}$ | $M_{A3}$ | $M_{B1}$ | $M_{B2}$ | $M_{B3}$ | $M_{C1}$ | $M_{C2}$ | $M_{C3}$ | $M_{D1}$ | $M_{D2}$ | $M_{D3}$ |
| 1 | X | X | X | | X | X | | X | X | | X | X | | | | |
| 2 | X | X | X | | X | | X | X | | X | X | | X | | | |
| 3 | X | X | X | | | X | X | | X | X | | X | X | | | |
| 4 | | X | X | X | | | | X | X | | X | X | | X | X | |
| 5 | | X | X | X | | | | X | | X | X | | X | X | | X |
| 6 | | X | X | X | | | | | X | X | | X | X | | X | X |
| 7 | X | | X | X | X | X | | | | | X | X | | X | X | |
| 8 | X | | X | X | X | | X | | | | X | | X | X | | X |
| 9 | X | | X | X | | X | X | | | | | X | X | | X | X |
| 10 | X | X | | X | X | X | | X | X | | | | | X | X | |
| 11 | X | X | | X | X | | X | X | | X | | | | X | | X |
| 12 | X | X | | X | | X | X | | X | X | | | | | X | X |

X = frequency notch present i.e. ion transmitted.

According, to another embodiment a mass spectrometer may be provided as shown in FIG. 7B wherein the mass spectrometer comprises an ion source 17, a preferred ion guide or mass filter device 6, a collision, fragmentation or reaction device 22 and a Time of Flight mass analyzer 24. In this embodiment, two or more parent ions may be selected and transmitted through the preferred ion guide or mass filter 6 by applying a notched broadband frequency signal having two or more frequency notches in a manner according to the preferred embodiment. The selected and onwardly transmitted parent ions are then preferably arranged to undergo fragmentation in the collision, fragmentation or reaction device 22 thereby yielding a plurality of fragment or daughter ions. Fragment or daughter ion mass spectra may then preferably be collected or obtained using the Time of Flight mass analyzer 24 to mass analyze the fragment or daughter ions. The fragment or daughter ion mass spectra obtained when each of the notched broadband frequency signals are applied are preferably summed separately resulting in a single mass spectrum of data collected for each of the notched broadband frequency signals. By comparing the intensity modulated mass spectra for each daughter ion mass with the notched broadband frequency signals modulation pattern the data may be deconvoluted or decoded thereby extracting the daughter ion spectrum associated with each selected and transmitted parent ion.

Such an embodiment can be used, for example, to provide an improvement in the duty cycle and sensitivity of Data Directed Experiments carried out on tandem MS/MS instruments where the objective is to acquire automatically the daughter ion spectrum for each parent ion as it elutes from chromatography separation equipment. For example, in a conventional tandem Q-TOF® type mass spectrometer multiple parent ion candidates are identified from a survey scan. The parent ions are then selected sequentially and their corresponding fragment ion mass spectra are collected. According to the preferred embodiment the same data may be acquired with a higher duty cycle and sensitivity thereby potentially allowing more candidates to be selected at a given time.

According to another embodiment the second quadrupole mass filter 23 as shown in FIG. 7A or the Time of Flight mass analyzer 24 as shown in FIG. 7B may be replaced with another type of mass analyzer which is preferably capable of parallel detection such as a linear or 3D ion trap mass analyzer, a Fourier Transform Ion Cyclotron Resonance ("FTICR") mass analyzer, a Fourier Transform electrostatic ion trap ("orbitrap") mass analyzer, a Penning trap mass analyzer or a magnetic sector mass analyzer.

According to another embodiment a mass spectrometer may be provided comprising one or more ion guides, one or more mass analyzers, one or more means for inducing ion fragmentation, one or more means for inducing ion-molecule reactions, one or more means for inducing ion-ion reactions, one or more means for ion mobility separation, one or more means for differential ion mobility separation, or any combination thereof.

According to the preferred embodiment the broadband frequency signal(s) may comprise a synthesised spectrum of frequencies in which each frequency is coherent and is maintained for a period of time adequate to resonantly or parametrically excite and radially eject ions of a specific mass to charge ratio. The plurality of frequency notches may be generated by omission of the unrequired frequencies from the synthesised spectrum of frequencies comprising the broadband frequency signal. Each signal applied to the plurality of electrodes or rods may be programmed to have a different set of frequencies omitted from the same synthesised spectrum of frequencies comprising the broadband frequency signal.

Although the present invention has been described with reference to the preferred embodiments, it will be understood by those skilled in the art that various changes in form and detail may be made without departing from the scope of the invention as set forth in the accompanying claims.

The invention claimed is:

1. A method of guiding or mass filtering ions comprising:

providing an ion guide or mass filter device comprising a plurality of electrodes or rods;

applying an RF voltage to said plurality of electrodes or rods;

supplying a plurality of signals to said plurality of electrodes or rods, wherein said step of supplying said plurality of signals comprises at least the steps of:

(i) supplying a first signal to said plurality of electrodes or rods in order to resonantly or parametrically excite undesired ions within or from said ion guide or mass filter device, said first signal comprising a plurality of frequency notches, and obtaining a first set of data; and then (ii) supplying a second different signal to said plurality of electrodes or rods in order to resonantly or parametrically excite undesired ions within or from said ion guide or mass filter device, said second signal comprising a plurality of frequency notches, and obtaining a second set of data; and deconvoluting, decoding or demodulating said first set of data and said second set of data to determine the intensity of ions having a plurality of different mass to charge ratios.

2. A method as claimed in claim 1, wherein said step of supplying a plurality of signals further comprises supplying n additional signals to said plurality of electrodes or rods in sequence in order to resonantly or parametrically excite undesired ions within or from said ion guide or mass filter device and obtaining n additional sets of data, wherein said n additional signals each comprise a plurality of frequency notches; and wherein said step of deconvoluting, decoding or demodulating further comprises deconvoluting, decoding or demodulating said additional sets of data to determine the intensity of ions having a plurality of different masses or mass to charge ratios;

wherein n is selected from the group consisting of: (i) 1; (ii) 2; (iii) 3; (iv) 4; (v) 5; (vi) 6; (vii) 7; (viii) 8; (ix) 9; (x) 10; (xi) 11; (xii) 12; (xiii) 13; (xiv) 14; (xv) 15; (xvi) 16; (xvii) 17; (xviii) 18; (xix) 19; (xx) 20; (xxi) 20-25; (xxii) 25-30; (xxiii) 30-35; (xxiv) 35-40; (xxv) 40-45; (xxvi) 45-50; (xxvii) 50-55; (xxviii) 55-60; (xxix) 60-65; (xxx) 65-70; (xxxi) 70-75; (xxxii) 75-80; (xxxiii) 80-85; (xxxiv) 85-90; (xxxv) 90-95; (xxxvi) 95-100; and (xxxvii) >100; and wherein said first set of data and said second set of data and said additional sets of data comprise time of flight or mass spectral data.

3. A method as claimed in claim 2, wherein said step of supplying said first signal and said second signal and said additional signals results in at least some undesired ions being ejected radially from said ion guide or mass filter device or otherwise being substantially attenuated; and wherein at least some ions are onwardly transmitted without being substantially confined or trapped axially within said ion guide or mass filter device.

4. A method as claimed in claim 2, wherein said step of supplying said first signal and said second signal and said additional signals comprises:

(a) supplying a broadband frequency signal to said plurality of electrodes or rods; or (b) supplying a broadband frequency signal to said plurality of electrodes or rods wherein said first signal and said second signal and said additional signals comprise one or more frequency components selected from one of more of the following ranges: (i) <1 kHz; (ii) 1-2 kHz; (iii) 2-3 kHz; (iv) 3-4 kHz; (v) 4-5 kHz; (vi) 5-6 kHz; (vii) 6-7 kHz; (viii) 7-8 kHz; (ix) 8-9 kHz; (x) 9-10 kHz; (xi) 10-11 kHz; (xii) 11-12 kHz; (xiii) 12-13 kHz; (xiv) 13-14 kHz; (xv) 14-15 kHz; (xvi) 15-16 kHz; (xvii) 16-17 kHz; (xviii) 17-18 kHz; (xix) 18-19 kHz; (xx) 19-20 kHz; (xxi) 20-21 kHz; (xxii) 21-22 kHz; (xxiii) 22-23 kHz; (xxiv) 23-24 kHz; (xxv) 24-25 kHz; (xxvi) 25-26 kHz; (xxvii) 26-27 kHz; (xxviii) 27-28 kHz; (xxix) 28-29 kHz; (xxx) 29-30 kHz; and (xxxi) >30 kHz; or (c) supplying a signal having a dipolar or a quadrupolar waveform; or (d) supplying a signal having a plurality of frequency components which correspond with the secular, resonance, first or fundamental harmonic frequency of a plurality of ions received in use by said ion guide or mass filter device.

5. A method as claimed in claim 2, wherein said first signal and said second signal and said additional signals do not substantially cause at least some analyte ions of interest to be resonantly or parametrically excited or radially ejected from said ion guide or mass filter device.

6. A method as claimed in claim 1, wherein said step of applying an RF voltage further comprises:

(a) applying a two phase voltage to said plurality of electrodes or rods wherein opposite phases of said RF voltage are applied to adjacent electrodes or rods in order to confine ions radially within said ion guide or mass filter device; or (b) applying an RF voltage having an amplitude selected from the group consisting of: (i) <50 V peak to peak; (ii) 50-100 V peak to peak; (iii) 100-150V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-1000 V peak to peak; (xii) 1-2 kV peak to peak; (xiii) 2-3 kV peak to peak; (xiv) 3-4 kV peak to peak; (xv) 4-5 kV peak to peak; (xvi) 5-6 kV peak to peak; (xvii) 6-7 kV peak to peak; (xviii) 7-8kV peak to peak; (xix) 8-9 kV peak to peak; (xx) 9-10 kV peak to peak; and (xxi) >10 kV peak to peak; or (c) applying an RF voltage having a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0. MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

7. A method as claimed in claim 1, wherein at frequencies corresponding to said plurality of frequency notches either:

(a) ions within said ion guide or mass filter device are not substantially resonantly or parametrically excited; or (b) ions within said ion guide or mass filter device are resonantly or parametrically excited but are not sufficiently resonantly or parametrically excited such that the ions are caused to be radially ejected from said ion guide or mass filter device.

8. A method of mass spectrometry comprising a method as claimed in claim 1.

9. A method as claimed in claim 1, wherein said step of providing an ion guide or mass filter device comprises providing a quadrupole rod set ion guide or mass filter device.

10. An ion guide or mass filter device comprising:

a plurality of electrodes or rods;

an RF voltage supply for supplying an RF voltage to said plurality of electrodes or rods;

signal means arranged and adapted:

(i) to supply a first signal comprising a plurality of frequency notches to said plurality of electrodes or rods in order to resonantly or parametrically excite undesired ions within or from said ion guide or mass filter device and wherein a first set of data is obtained; and then (ii) to supply a second different signal comprising a plurality of frequency notches to said plurality of electrodes or rods in order to resonantly or parametrically excite undesired ions within or from said ion guide or mass filter device and wherein a second set of data is obtained; and a device for deconvoluting, decoding or demodulating said first set of data and said second set of data to determine the intensity of ions having a plurality of different mass to charge ratios.

11. A mass spectrometer comprising an ion guide or mass filter device as claimed in claim 10.

12. A method of guiding or mass filtering ions comprising:

modulating, varying or synthesising a broadband frequency signal wherein a plurality of signals each having two or more frequency notches are sequentially generated and applied to an ion guide or mass filter device;

detecting ions transmitted by said ion guide or mass filter using an ion detector; and demodulating, deconvoluting, decoding or deconstructing a signal output by said ion detector in order to determine the intensity of ions having a plurality of different mass to charge ratios.

13. A method as claimed in claim 12, wherein said step of demodulating, deconvoluting, decoding or deconstructing comprises using a phase locked amplifier or a neural network or a decoding routine or algorithm or a wavelet based demodulation technique.

14. Apparatus comprising:

an ion guide or mass filter device;

a device for modulating, varying or synthesising a broadband frequency signal wherein a plurality of signals each having two or more frequency notches are sequentially generated and applied to said ion guide or mass filter device;

an ion detector for detecting ions transmitted by said ion guide or mass filter; and a device for demodulating, deconvoluting, decoding or deconstructing a signal output by said ion detector in order to determine the intensity of ions having a plurality of different mass to charge ratios.

15. Apparatus as claimed in claim 14, wherein said device for demodulating, deconvoluting, decoding or deconstructing comprises a phase locked amplifier or a neural network or a decoding routine or algorithm or a wavelet based demodulator.

* * * * *